US006360706B1

(12) United States Patent
Skinner et al.

(10) Patent No.: US 6,360,706 B1
(45) Date of Patent: Mar. 26, 2002

(54) SHIELD AND SPRING INTERFACE TO A SPARK PLUG FROM A PENCIL COIL

(75) Inventors: Albert Anthony Skinner; Raymond O. Butler, Jr.; Viorel N. Moga, all of Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/518,574

(22) Filed: Mar. 3, 2000

(51) Int. Cl.[7] ..... F02P 1/00
(52) U.S. Cl. ..... 123/169 PH; 123/635
(58) Field of Search ..... 123/169 PH, 169 PA, 123/143 C, 633, 634, 635; 439/126, 127, 128

(56) References Cited

U.S. PATENT DOCUMENTS 4,159,441 A * 6/1979 Livingston ..... 123/633
5,014,656 A * 5/1991 Leptich et al. ..... 123/169
5,351,670 A * 10/1994 Buma et al. ..... 123/635
5,794,603 A * 8/1998 Miyamoto ..... 123/634

* cited by examiner

*Primary Examiner*—John Kwon

(74) *Attorney, Agent, or Firm*—Margaret A. Dobrowitsky

(57) ABSTRACT

An interface device for interfacing a pencil coil to a spark plug is provided. The interface device comprises a substantially C-shaped spring adapted to mechanically and electrically engage a pencil coil shield and also adapted to make electrical contact with a spark plug ground while the spring remains mechanically and electrically engaged to the pencil coil shield. Also provided is a pencil coil shield assembly for interfacing a pencil coil to a spark plug. The pencil coil shield assembly comprises a substantially cylindrical pencil coil and a spring. The substantially cylindrical pencil coil shield is adapted to surround the pencil coil. The spring is mechanically and electrically engaged with the pencil coil shield and is adapted to make electrical contact with a spark plug ground while the spring remains mechanically and electrically engaged to the pencil coil shield. The interface device and/or pencil coil shield assembly can be configured to reduce RFI from the secondary current winding currents of a pencil coil. In addition, each can be manufactured using inexpensive and uncomplicated manufacturing and installation techniques, and using starting materials and parts that are relatively inexpensive. Also provided is a method of reducing RFI from secondary winding currents of a pencil coil by, among other things, electrically connecting the substantially cylindrical shield to a low voltage terminal of a secondary winding of the pencil coil, and electrically connecting the substantially cylindrical shield to a spark plug ground of a spark plug associated with the pencil coil.

32 Claims, 3 Drawing Sheets

SHIELD AND SPRING INTERFACE TO A SPARK PLUG FROM A PENCIL COIL

BACKGROUND OF THE INVENTION

1. Field of the Invention

The present invention relates to a shield and spring interface to a spark plug from a pencil coil.

2. Discussion of the Related Art

A typical automotive ignition system includes a spark plug, for each combustion chamber of an engine, at least one ignition coil and at least one device adapted to selectively charge the coil(s) and cause the energy stored in the coil(s) to be discharged through the spark plugs in a timed manner so that a spark is generated and ignition of a fuel-air mixture in each combustion chamber occurs at a specified timing.

Recent technological advances have made it more practical and desirable to provide each combustion chamber (or cylinder) with its own dedicated coil, and to provide each coil in a relatively compact configuration at the top of each combustion chamber's spark plug. Such coils are customarily referred to as "pencil coils". The diameters of such pencil coils enable at least a portion of the coil to extend into the spark plug well on the typical engine, thereby providing efficient use of the limited space therein.

Pencil coils typically are equipped with a conductive shield. The conductive shield surrounds the pencil coil and tends to reduce radio frequency interference (RFI) from the coil. A significant source of RFI, however, is the electrical current path from the secondary winding. In the typical pencil coil arrangement, the spark plug is grounded to the engine and the return path for the electrical current in the secondary winding to the low voltage terminal of the secondary winding is through components located outside of the shield. The secondary winding current flowing through the components located outside of the shield provides a significant source of RFI. Thus, despite the presence of the shield, the typical pencil coil arrangement does not eliminate a significant portion of the RFI caused by the secondary winding current.

There is consequently a need in the art for way of reducing the RFI caused by the secondary winding current. Since it is desirable to keep costs and complexity to a minimum, there is a need in the art for a way of reducing this RFI without significantly increasing the cost, time, or complexity of the ignition system or the manufacturing and/or installation processes associated therewith.

SUMMARY OF THE INVENTION

It is a primary object of the present invention to overcome the foregoing problems and/or to satisfy at least one of the aforementioned needs by providing a shield and spring interface to a spark plug from a pencil coil.

To achieve this and other objects and advantages, the present invention provides an interface device for interfacing a pencil coil to a spark plug. The interface device comprises a substantially C-shaped spring adapted to mechanically and electrically engage a pencil coil shield and also adapted to make electrical contact with a spark plug ground while the spring remains mechanically and electrically engaged to the pencil coil shield.

Also provided by the present invention is a pencil coil shield assembly for interfacing a pencil coil to a spark plug. The pencil coil shield assembly comprises a substantially cylindrical pencil coil and a spring. The substantially cylindrical pencil coil shield is adapted to surround the pencil coil. The spring is mechanically and electrically engaged with the pencil coil shield and is adapted to make electrical contact with a spark plug ground while the spring remains mechanically and electrically engaged to the pencil coil shield.

The present invention also provides a pencil coil shield assembly for interfacing a pencil coil to a spark plug, the assembly comprising a substantially cylindrical pencil coil shield adapted to surround the pencil coil and means mechanically engaged to the pencil coil shield, for electrically connecting the pencil coil shield with a spark plug ground.

Advantageously, the foregoing interface device and/or pencil coil shield assemblies can be configured to reduce RFI from the secondary current winding currents of a pencil coil. In addition, each can be manufactured using inexpensive and uncomplicated manufacturing and installation techniques, and using starting materials and parts that are relatively inexpensive.

Also provided by the present invention is a method of reducing RFI from secondary winding currents of a pencil coil. The method comprises the steps of providing a substantially cylindrical shield around a pencil coil, electrically connecting the substantially cylindrical shield to a low voltage terminal of a secondary winding of the pencil coil, and electrically connecting the substantially cylindrical shield to a spark plug ground of a spark plug associated with the pencil coil.

Still other objects, advantages, and features of the present invention will become more readily apparent when reference is made to the accompanying drawing and the associated description contained therewith.

DESCRIPTION OF PREFERRED EMBODIMENTS

Figure 1:
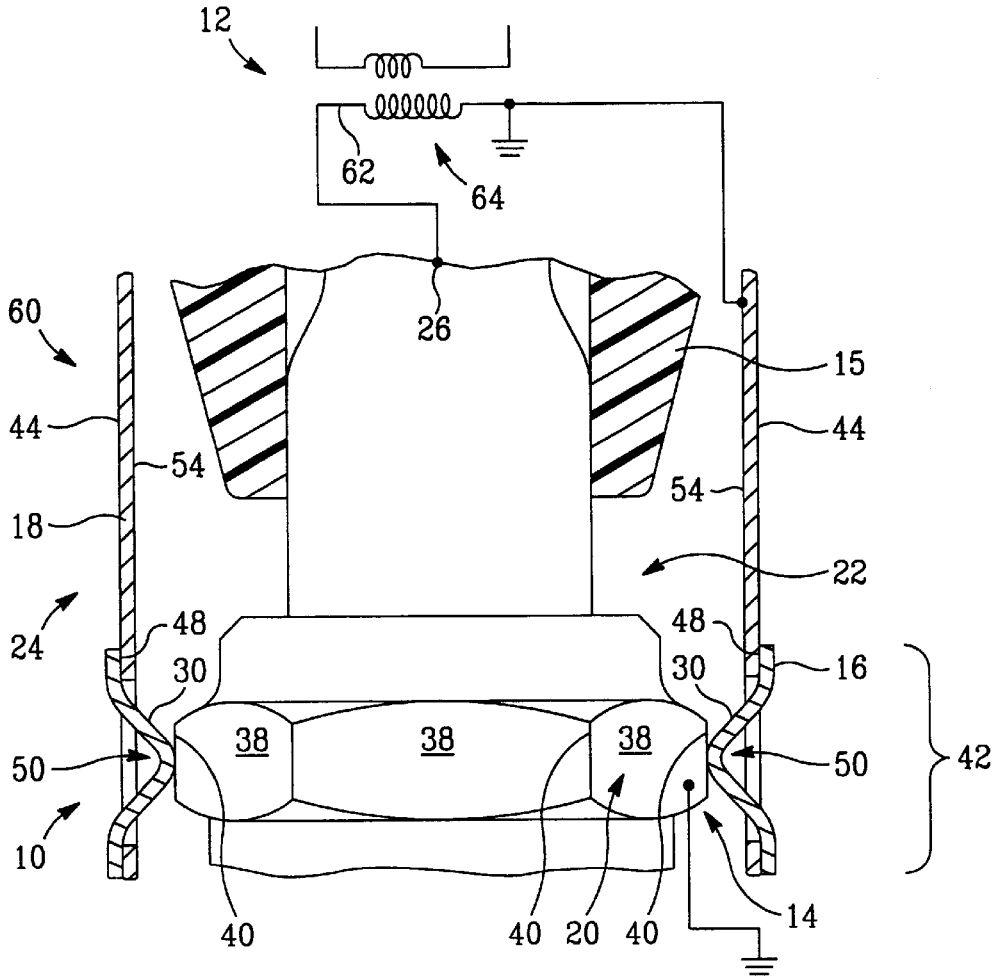
FIG. 1 is a partially cross-sectional, fragmentary view of an interface device in a pencil coil shield assembly, according to a preferred embodiment of the present invention, wherein the pencil coil is shown schematically.

FIG. 1 illustrates an interface device 10 for interfacing a pencil coil 12 (shown schematically) to a spark plug ground 14, according to a preferred embodiment of the present invention. While the pencil coil 12 is shown schematically in FIG. 1, it is understood that the physical location of the pencil coil 12 is inside a pencil coil housing, the bottom 15 of which is shown in FIG. 1.

The interface device 10 includes a substantially C-shaped spring 16. The C-shaped spring 16 is adapted to mechanically and electrically engage a pencil coil shield 18 and is also adapted to make electrical contact with the spark plug ground 14 while the spring 16 remains mechanically and electrically engaged with the pencil coil shield 18.

The spark plug ground 14 in FIG. 1 is a conventional spark plug ground. It has a hexagonally shaped feature 20 that can be engaged by a conventional spark plug wrench. Installation of the spark plug 22 is performed by applying the wrench to the hexagonally shaped feature 20 and turning the hexagonally shaped feature 20 using the wrench. After installation, the wrench is removed and the pencil coil assembly 24 is mounted over the spark plug 22 so that the high voltage terminal 26 (shown schematically) of the spark plug 22 engages a high voltage terminal 28 (shown schematically) of the pencil coil assembly 24 and so that the pencil coil shield 18 surrounding the pencil coil 12 also surrounds the upper portion of the spark plug 22.

As shown in FIG. 1, the spring 16 can have radially inward protuberances 30 adapted to mechanically and electrically engage the spark plug ground 14. The protuberances 30 shown in FIG. 1 are about 180 degrees from one another about the circumference of the spring 16.

Figure 2:
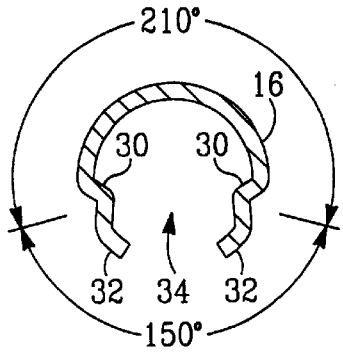
FIG. 2 is a cross-sectional top view of a spring according to another preferred embodiment of the present invention.

As shown in FIG. 2, the protuberances 30 preferably are located near distal ends 32 of the spring 16 and are spaced apart from one another by about 210 degrees about the circumference of the substantially C-shaped spring 16. When measured across a gap 34 between the distal ends 32 of the spring 16, these protuberances 30 are about 150 degrees apart. This 210/150-degree arrangement of the protuberances 30 advantageously limits variance in deflection of the spring 16 to less than about 4% when the substantially hexagonal feature 20 of the spark plug ground 14 is a perfect (equilateral) hexagon. In particular, one protuberance 30 is located in the middle of a side 38 of the hexagon whenever the other protuberance 30 is located at an apex 40.

Preferably, the substantially C-shaped spring 16 is made from sheet metal that has been reconfigured to provide the C-shape of the spring 16. Each of the protuberances 30 can be defined by a radially inward bend in the sheet metal. The spring 16, in this regard, can be manufactured in a relatively inexpensive and uncomplicated manner. While the spring 16 preferably is made of steel, it is understood that other conductive materials can be used.

The substantially C-shaped spring 16 preferably has a diameter substantially equal to an outside diameter of the shield 18. This allows the spring 16 to be mounted securely and conveniently to a portion 42 of the outside major surface 44 of the shield 18. That portion 42 of the shield's outside major surface 44 therefore bears against the major inside surface 48 of the spring 16. The shield 18 preferably has openings 50 aligned with the protuberances 30, through which the protuberances 30 extend to make contact with the spark plug ground 14.

It is understood, however, that the invention is not limited to such mounting of the spring 16. To the contrary, the spring 16 can be provided with a diameter substantially equal to the inside diameter of the shield 18 and can be mounted to the inside surface 54 of the shield 18. Regardless of which mounting configuration is used, it is preferred that the interconnection between the spring 16 and shield 18 be reinforced or otherwise integrated, for example, by welding.

The combination of the shield 18 and the spiring 16 advantageously provides a pencil coil shield assembly 60 that is capable of interfacing the pencil coil 12 to the spark plug 22. In the resulting assembly 60, the shield 18 is adapted to surround the pencil coil 12, and the spring 16 is mechanically and electrically engaged with the pencil coil shield 18 and is adapted to make electrical contact with the spark plug ground 14 while the spring 16 remains mechanically and electrically engaged to the pencil coil shield 18.

Preferably, the shield 18 is electrically connected to a low voltage terminal 62 of the secondary winding 64 of the pencil coil 12 so that a return path for a secondary winding current is established from the spark plug ground 14, through the spring 16, through the shield 18, and into the low voltage terminal 62, whenever the spring 16 makes electrical contact with the spark plug ground 14. This advantageously provides a more direct return path for the secondary winding current than arrangements that rely solely on an indirect return path through the engine and its associated components. This more direct path advantageously provides a significant reduction in RFI from the secondary winding current of the pencil coil 12.

Figure 3:
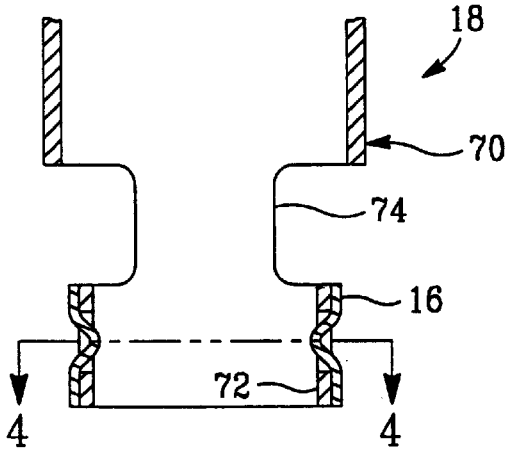
FIG. 3 is a cross-sectional view of a modified pencil coil shield and a spring according to a preferred embodiment of the present invention.
Figure 4:
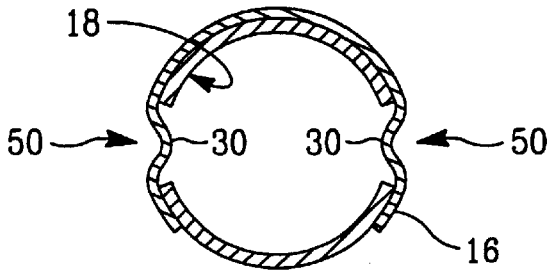
FIG. 4 is a cross-sectional view of the modified pencil coil shield and spring of FIG. 3, taken along line IV—IV in FIG. 3.
Figure 5:
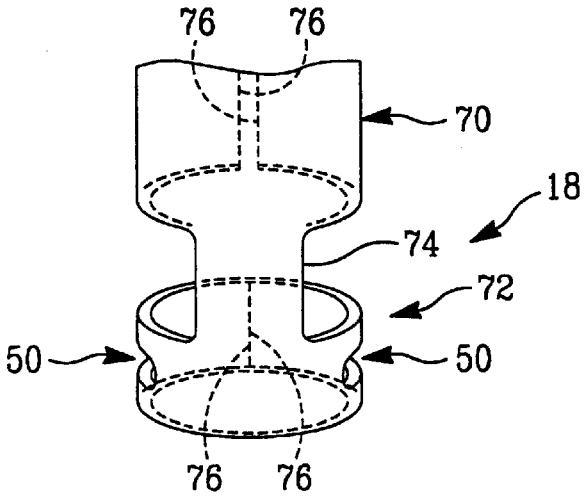
FIG. 5 is a perspective view of the modified pencil coil shield shown in FIG. 3.

With reference to FIGS. 3–5, the pencil coil shield 18 can be modified so that it includes a main substantially cylindrical body 70 and a ring-shaped spring mount 72. The ring-shaped spring mount 72 is connected to the substantially cylindrical body 70 by an extension 74 of the body 70. Preferably, the ring-shaped spring mount 72 is coaxially arranged with respect to the substantially cylindrical body 70. This modified shield 18 advantageously can be manufactured in a relatively inexpensive and uncomplicated manner from sheet metal, such as steel, that is reconfigured to provide the illustrated shape. In particular, the sheet metal can be stamped and then rolled into the shape shown in FIGS. 3–5. The lateral ends 76 that are brought together during the rolling process, then can be welded to one another. Other manufacturing techniques and conductive materials also can be used.

In the exemplary embodiment of FIGS. 3–5, the spring 16 is engaged to the spring mount 72 and preferably is welded thereto. The spring 16 is substantially C-shaped and has its protuberances 30 spaced about 180 degrees apart from one another about the circumference of the spring 16. The openings 50 in the ring-shaped spring mount 72 are correspondingly aligned. The protuberances 30 therefore can extend through the openings 50 and can mechanically and electrically engage the spark plug ground 14 (shown in FIG. 1).

Preferably, the openings 50 in the spring mount 72 are arranged in the aforementioned 210/150 degree configuration, and the protuberances 30 of the spring 16 are arranged in a corresponding manner. The resulting arrangement advantageously limits variance in deflection of the spring 16 to less than 4% when the substantially hexagonal feature 20 of the spark plug ground 14 is a perfect (equilateral) hexagon.

Figure 6:
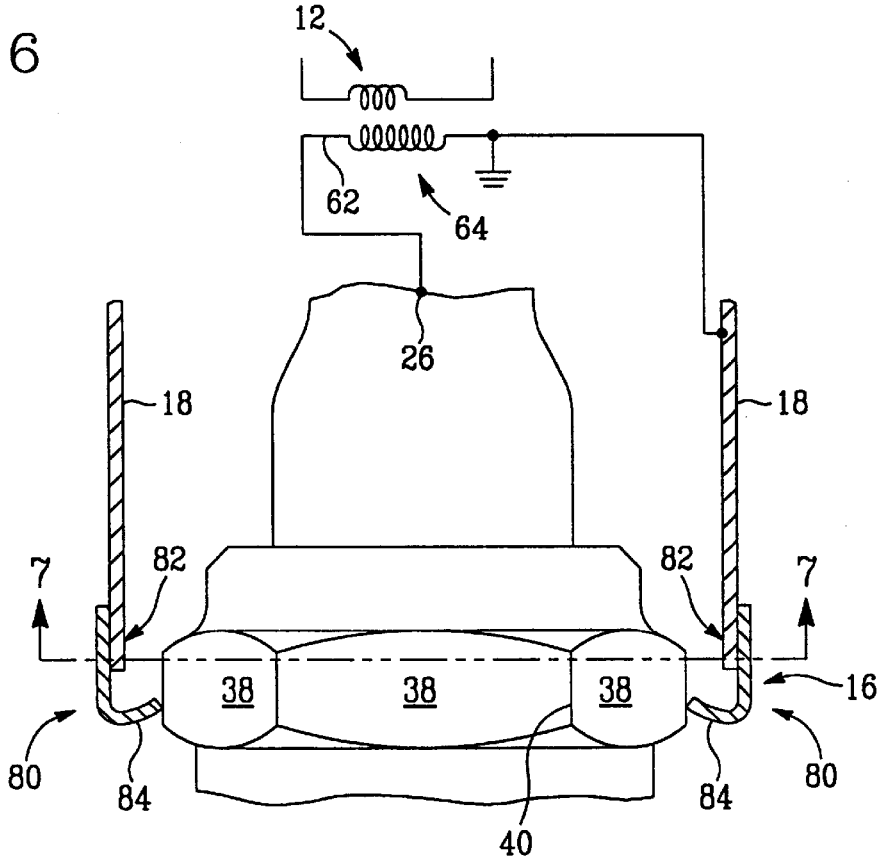
FIG. 6 is a partially cross-sectional, fragmentary view of a spark plug, at least one spring in tab form, and a pencil coil shield, according to an alternative embodiment of the present invention.
Figure 7:
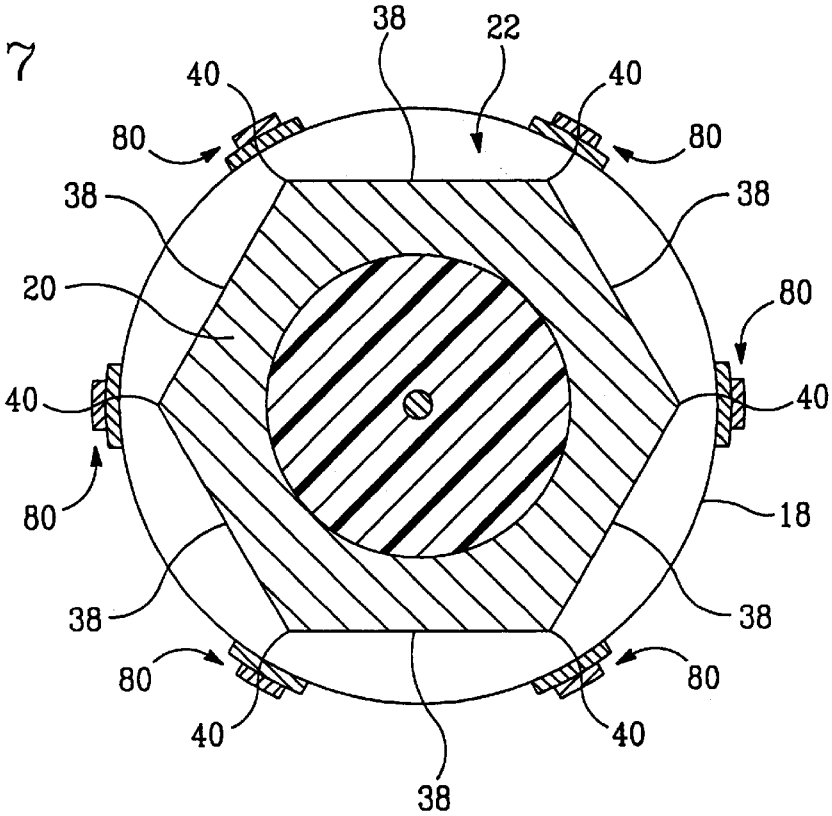
FIG. 7 is a partially cross-sectional view of the spark plug, the springs in tab form, and the pencil coil shield of FIG. 6, taken along line VII—VII of FIG. 6.

With reference to FIG. 6, an alternative embodiment of the spring 16 is provided in the form of at least one tab 80 that extends down from the shield 18 and then in a substantially radially inward direction to make electrical contact with a spark plug ground 14. The tab 80 can be welded or otherwise integrated with the shield 18. Preferably, each tab 80 is substantially hook-shaped. While FIG. 6 shows a two-piece tab structure, wherein one portion 82 of each tab 80 is integral with the shield 18, and the other hookshaped portion 84 is welded thereto, it is understood that one-piece or other alternative tab structures can be used.

Multiple tabs 80 preferably are provided. One tab 80, for example, can be provided for each apex 40 of a hexagonally shaped feature 20 of the spark plug ground 14.

The tabs 80 desirably are spaced apart from one another symmetrically about a circumference of the shield 18. Preferably, the tabs 80 are arranged with respect to one another about the shield 18 in such a way that, when the spring 16 is applied to a spark plug ground 14 that has a generally hexagonal shape and in such a way that one of the tabs 80 engages an apex 40 of the generally hexagonal shape, others of the tabs 80 also engage other apexes 40 of the generally hexagonal shape.

In any of the foregoing embodiments, the shield 18 can be connected to a low voltage terminal 62 of the pencil coil 12 to provide a significantly more direct return path for the secondary winding current. As indicated above, this more direct return path provides a significant reduction in RFI from the secondary winding current. The reduction in RFI, in turn, permits the use of a lower spark plug resistance. A lower spark plug resistance provides a corresponding increase in the ignition system's efficiency. Yet another benefit of the more direct return path for the secondary winding current relates to the wiring needs of the engine. In particular, the more direct current path may provide a reduction in the number of wires needed in the wiring harness associated with the engine.

The present invention thus provides, among other things, a method of reducing RFI from secondary winding currents of a pencil coil 12. Generally, the method comprises the steps of providing a substantially cylindrical shield 18 around a pencil coil 12, electrically connecting the substantially cylindrical shield 18 to a low voltage terminal 62 of a secondary winding 64 of the pencil coil 12, and electrically connecting the substantially cylindrical shield 18 to the spark plug ground 14 of the spark plug 22 associated with the pencil coil 12.

Preferably, the step of electrically connecting the substantially cylindrical shield 18 to the spark plug ground 14 is performed using a spring 16 (e.g., one of the springs 16 described above) so that a direct return path for the current in the secondary winding 64 is established from the spark plug ground 14, through the spring 16, through the shield 18, and into the low voltage terminal 62, whenever the spring 16 makes electrical contact with the spark plug ground 14.

The step of electrically connecting the substantially cylindrical shield 18 to the spark plug ground 14 can be performed on a hexagonal feature 20 of the spark plug ground 14. Preferably, this step is performed in such a way that spring variance in deflection is limited to less than about 4% during any axial rotation of the shield 18. Use of the aforementioned 210/150-degree arrangement is one way of providing such a limit on the spring's variance of deflection.

While the dimensions of the spring 16 and shield 18 in the foregoing embodiments will depend to some extent on the spark plug ground 14 dimensions and the diameter of the pencil coil 12, there arc certain standard dimensions that are well known in the art. One standard dimension, for example, relates to the distance from one apex 40 of a hexagonally shaped feature 20 on the spark plug ground 14 to the opposite apex 40. A standard value for this distance is about 17.7 millimeters. Therefore, if the spring 16 has its protuberances 30 positioned 180 degrees apart from one another, the spring should urge its protuberances 30 toward a position where there is less than 17.7 millimeters between the protuberances 30. A common pencil coil dimension also permits the shield 18 to have an outside diameter of about 20 millimeters. The diameter of the spring 16 can be provided accordingly, and in a manner dependent upon whether the spring 16 will engage the outside surface 44 or inside Surface 54 of the shield 18. Still other standard dimensions for the spring 16 and spring mount 72 can be derived from alternative standard dimensions of the shield 18, of the pencil coil 12 and of the spark plug ground 14.

While the present invention has been described with reference to certain preferred embodiments and implementations, it is understood that various modifications and variations will no doubt occur to those skilled in the art to which this invention pertains. These and all other such variations which basically rely of the teachings through which this disclosure has advanced the art are properly considered within the scope of this invention.

What is claimed is:

1. An interface device for interfacing a pencil coil to a spark plug comprising:

a substantially C-shaped spring adapted to mechanically and electrically engage a pencil coil shield and also adapted to make electrical contact with a spark plug ground while the spring remains mechanically and electrically engaged to the pencil coil shield.

2. The interface device of claim 1, wherein said spring has radially inward protuberances adapted to mechanically and electrically engage a spark plug ground.

3. The interface device of claim 2, wherein the protuberances are spaced apart from one another by about 210 degrees about the circumference of the substantially C-shaped spring.

4. The interface device of claim 2, wherein the protuberances are located near distal ends of the substantially C-shaped spring.

5. The interface device of claim 4, wherein the protuberances are located near distal ends of the substantially C-shaped spring and are spaced apart from one another by about 210 degrees about the circumference of the substantially C-shaped spring.

6. The interface device of claim 2, wherein the substantially C-shaped spring is made from sheet metal that has been reconfigured to provide the C-shape of the spring.

7. The interface device of claim 6, wherein each of the protuberances is defined by a radially inward bend in the sheet metal.

8. The interface device of claim 1, wherein the substantially C-shaped spring has a diameter substantially equal to an inside or outside diameter of the shield.

9. A pencil coil shield assembly for interfacing a pencil coil to a spark plug comprising:

a substantially cylindrical pencil coil shield adapted to surround a pencil coil;

a spring mechanically and electrically engaged with the pencil coil shield and adapted to make electrical contact with a spark plug ground while the spring remains mechanically and electrically engaged to the pencil coil shield.

10. The pencil coil shield assembly of claim 9, wherein said spring is substantially C-shaped and has radially inward protuberances adapted to mechanically and electrically engage a spark plug ground.

11. The pencil coil shield assembly of claim 10, wherein the protuberances are spaced apart from one another by about 210 degrees about the circumference of the spring.

12. The pencil coil shield assembly of claim 10, wherein the protuberances are located near distal ends of the spring.

13. The pencil coil shield assembly of claim 12, wherein the protuberances are located near distal ends of the spring and are spaced apart from one another by about 210 degrees about the circumference of the spring.

14. The pencil coil shield assembly of claim 10 wherein the spring is made from sheet metal that has been reconfigured to provide the C-shape of the spring.

15. The pencil coil shield assembly of claim 14, wherein each of the protuberances is defined by a radially inward bend in the sheet metal.

16. The pencil coil shield assembly of claim 9, wherein the spring is substantially C-shaped and has a diameter substantially equal to an inside or outside diameter of the shield, the spring being arranged with respect to the shield so that a portion of a major surface of the shield bears against a major surface of the spring.

17. The pencil coil shield assembly of claim 16, wherein said major surface of the shield is an outer surface of the shield and said major surface of the spring is an inside surface of the spring.

18. The pencil coil shield assembly of claim 17, wherein said spring has radially inward protuberances adapted to mechanically and electrically engage a spark plug ground; and wherein the shield has openings aligned with the protuberances, through which said protuberances extend to make contact with a spark plug ground.

19. The pencil coil shield assembly of claim 9, wherein said shield is electrically connected to a low voltage terminal of a secondary winding of a pencil coil so that a return path for a secondary winding current is established from a spark plug ground, through the spring, through the shield, and into the low voltage terminal, when the spring makes electrical contact with the spark plug ground.

20. The pencil coil shield assembly of claim 9, wherein said pencil coil shield includes a main substantially cylindrical body and a ring-shaped spring mount that is connected to the substantially cylindrical body by an extension of the body.

21. The pencil coil shield assembly of claim 20, wherein said spring is engaged to the ring-shaped spring mount.

22. The pencil coil shield assembly of claim 20, wherein said ring-shaped mount is coaxially arranged with respect to the substantially cylindrical body.

23. The pencil coil shield assembly of claim 20, wherein said spring is substantially C-shaped and has radially inward protuberances adapted to mechanically and electrically engage a spark plug ground; and wherein the ring-shaped mount of the shield has openings aligned with the protuberances, through which said protuberances extend to make contact with a spark plug ground.

24. The pencil coil shield assembly of claim 9, wherein said spring, is provided in the form of at least one tab that extends from the shield in a substantially radially inward direction to make electrical contact with a spark plug ground.

25. The pencil coil shield assembly of claim 24, wherein said at least one tab is substantially hook-shaped.

26. The pencil coil shield assembly of claim 24, wherein said at least one tab comprises a plurality of tabs spaced apart from one another symmetrically about a circumference of the shield.

27. The pencil coil shield assembly of claim 26 wherein said plurality of tabs are arranged with respect to one another about the shield in such a way that, when said spring is applied to a spark plug ground that has a generally hexagonal shape and in such a way that one of the tabs engages an apex of the generally hexagonal shape, others of said tabs also engage other apexes of the generally hexagonal shape.

28. A pencil coil shield assembly for interfacing a pencil coil to a spark plug comprising:

a substantially cylindrical pencil coil shield adapted to surround a pencil coil;

means mechanically engaged to the pencil coil shield, for electrically connecting the pencil coil shield with a spark plug ground.

29. A method of reducing RFI from secondary winding currents of a pencil coil, said method comprising the steps of:

providing a substantially cylindrical shield around a pencil coil;

electrically connecting the substantially cylindrical shield to a low voltage terminal of a secondary winding of the pencil coil; and electrically connecting the substantially cylindrical shield to a spark plug ground of a spark plug associated with the pencil coil.

30. The method of claim 29, wherein said step of electrically connecting the substantially cylindrical shield to a spark plug ground is performed using a spring so that a direct return path for a secondary winding current is established from the spark plug ground, through the spring, through the shield, and into the low voltage terminal, when the spring makes electrical contact with the spark plug ground.

31. The method of claim 30, wherein said step of electrically connecting the substantially cylindrical shield to a spark plug ground is performed on a hexagonal portion of the spark plug ground.

32. The method of claim 31, wherein said step of electrically connecting the substantially cylindrical shield to a spark plug ground is performed in such a way that spring variance in deflection is limited to less than 4% during any axial rotation of the shield.

* * * * *